US006315298B1

(12) United States Patent
Kildea et al.

(10) Patent No.: US 6,315,298 B1
(45) Date of Patent: Nov. 13, 2001

(54) TURBINE DISK AND BLADE ASSEMBLY SEAL

(75) Inventors: Robert J. Kildea, North Palm Beach; Herbert R. Voigt, Palm Beach Gardens, both of FL (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/444,932

(22) Filed: Nov. 22, 1999

(51) Int. Cl.[7] ..... F16J 15/16

(52) U.S. Cl. ..... 277/433; 277/647; 416/220 R; 416/500

(58) Field of Search ..... 277/433, 644, 277/630, 632, 637, 647; 415/231, 230, 174.2; 416/215, 216, 217, 221, 248, 220 R, 219 R, 193 A, 190, 500

(56) References Cited

U.S. PATENT DOCUMENTS 3,383,094 * 5/1968 Diggs .
4,101,245 * 7/1978 Hess et al. ..... 416/190
4,183,720 * 1/1980 Brantley ..... 416/193 A
4,516,910 * 5/1985 Bouiller et al. ..... 416/190
4,936,749 * 6/1990 Arrao et al. ..... 416/193 A
5,160,243 * 11/1992 Herzner et al. ..... 416/220 R
5,240,375 * 8/1993 Wayte ..... 416/219 R
5,257,909 * 11/1993 Glynn et al. ..... 416/220 R
5,460,489 * 10/1995 Benjamin et al. ..... 416/248
5,743,713 * 4/1998 Hattori et al. ..... 416/215
5,785,499 * 7/1998 Houston et al. ..... 416/248
5,827,047 * 10/1998 Gonsor et al. ..... 416/193 A

FOREIGN PATENT DOCUMENTS

0210940 * 2/1987 (EP) .

* cited by examiner

*Primary Examiner*—Anthony Knight
*Assistant Examiner*—Alison K. Pickard
(74) *Attorney, Agent, or Firm*—Norman Friedland

(57) ABSTRACT

A seal for the aft end of a turbine blade and disk assembly of a gas turbine engine to prevent leakage of the cooling air whose main body and cross section are U-shaped that freely fits into a groove formed in the disk lug adjacent the rim of the disk on the aft side thereof. When rotating the center of the base of the U bears against the buttress of the platform of the blade and centrifugal force forces the sides of the U to deform to bear against the walls of the groove.

5 Claims, 3 Drawing Sheets

TURBINE DISK AND BLADE ASSEMBLY SEAL

TECHNICAL FIELD

This invention relates to gas turbine engines and particularly to the seal that serves to seal the interface between the blade and disk of a turbine rotor to prevent leakage of the engine's cooling air.

BACKGROUND OF THE INVENTION

As one skilled in the gas turbine engine technology appreciates the performance of the gas turbine engine for powering aircraft is ever increasing and as a consequence to this high performance, the pressure drop across a single stage high pressure turbine is sharply increasing. This large pressure drop presents an ever increasing problem in leakage of the engine's cooling air across the rim area of the turbine disk where the blades are mounted thereon. This is particularly the case when the root of the blade is configured in a firtree shape that fits into a complementary shaped broach formed in the rim of the supporting turbine disk. Obviously, the leakage across the rim area is a deficit in terms of engine performance and is a problem that necessitates a solution.

As one skilled in this art appreciates, one of the methods for solving this problem in heretofore known turbine power plants of the type where the pressure drop was not as large as that being considered in today's modern day engines, is by use of a cover plate mounted on the aft end of the turbine disk. This coverplate serves to seal between the disk and the blade and prevents leakage of the engine's cooling air in this area.

Because the rotational speed and temperature of the turbine rotor are so high at this station of the engine, the cover plate is precluded as being viable as a seal for this area. This is because at these higher rotational speeds and temperatures, the cover plate can not be extended out to the blade platform where the leakage occurs. The problem is acerbated because the leak path between the disk lug and the underside of the blade platform opens up as the rotor speed and blade temperature increase. To even add to the leakage problem the "G" loadings are significantly high at this location and together with the high temperature, this area is extremely difficult to seal.

We have found that we can obviate the leakage problem by providing a discreetly contoured seal at a judicious location at the aft end of the rim of the turbine disk inserted into a groove formed in the disk lug and retained by the projection (buttress) under the platform at the aft end of the blade attachment. The seal is free floating in the groove and is sized so that its center contacts the buttress of the blade and the centrifugal force, when the rotor rotates will tend to deform the seal until it contacts the sides of the groove in the disk. This forms an efficacious three (3) point sealing and prevents cooling air from leaking under and around the seal.

SUMMARY OF THE INVENTION

An object of this invention is to provide a seal at the interface of the blade and disk of the first stage turbine assembly of a gas turbine engine.

A feature of this invention is to provide a contoured seal located in a cavity formed by a groove in the aft end of the turbine disk lug and trapped radially by the blade. Centrifugal loadings during rotation of the turbine rotor forces the seal to bear against the side walls of the disk groove and a point on the blade buttress to define a three (3) point sealing configuration.

This invention is characterized as being relatively simple to construct and assemble, economical to make while providing efficacious sealing in the location of the gas turbine engine where the temperature, speed and G-loadings are sufficiently high to negate the generally acceptable cover plate seal.

The foregoing and other features of the present invention will become more apparent from the following description and accompanying drawings.

Figure 1:
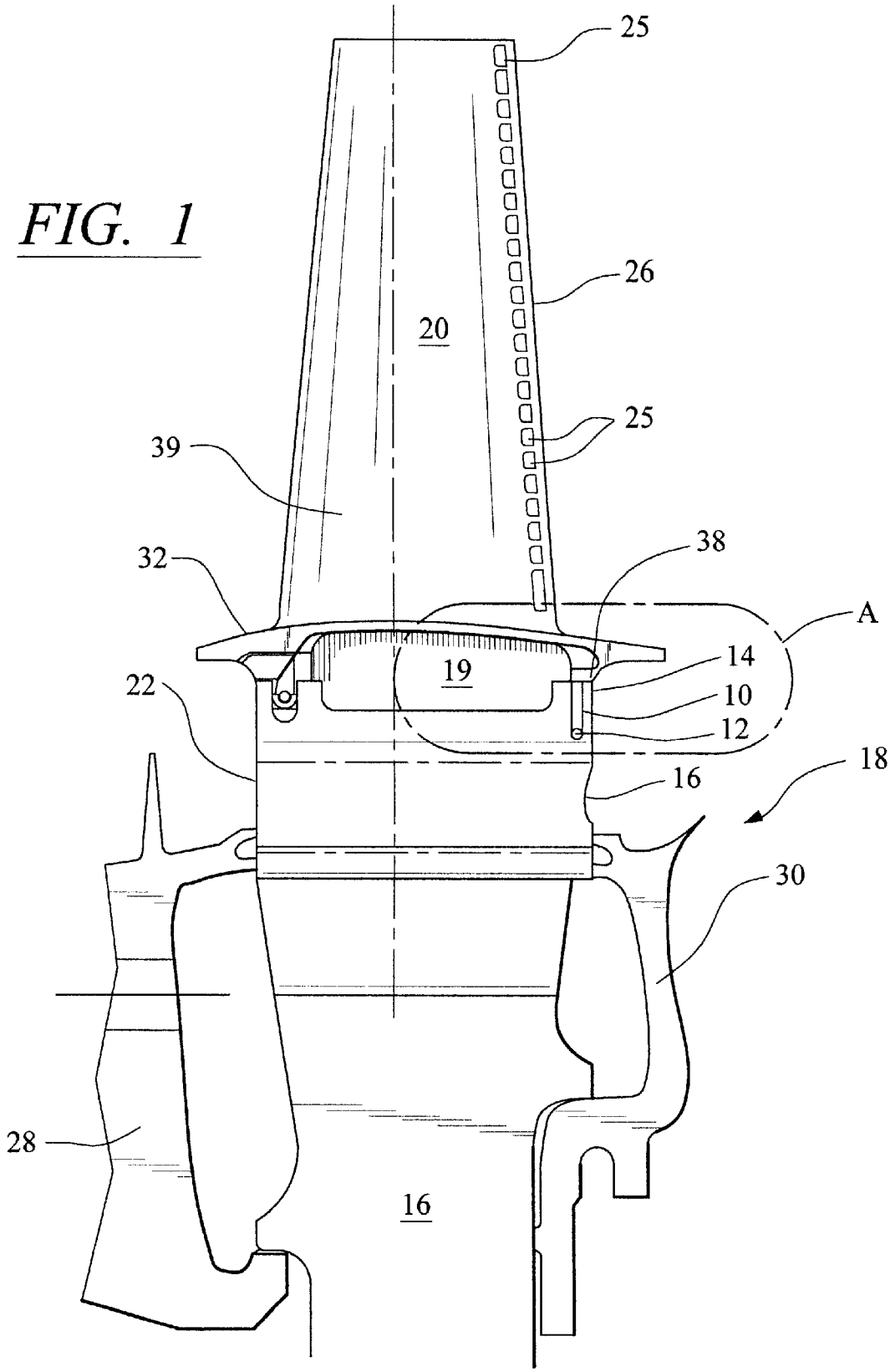
FIG. 1 is a partial view in elevation illustrating the invention as applied to a prior art turbine rotor.

These figures merely serve to further clarify and illustrate the present invention and are not intended to limit the scope thereof.

DETAILED DESCRIPTION OF THE INVENTION

While this invention is being described as being applicable to a single stage turbine for a gas turbine engine powering aircraft, as one skilled in this art will appreciate, this invention has applications in other environments where it is necessary to seal the area adjacent the interface of a turbine disk/blade assembly.

Referring next to all the FIGS. the invention comprises a thin sheet metal seal generally indicated by reference numeral 10 that is discreetly configured and freely mounted in groove 12 extending radially in the disk lug 14 located on the aft end of turbine disk 16. The seal 10 serves to prevent the air from escaping from cavity 19 which as noted above would result in a deficit of engine performance. The cavity 19 is fed cooling air from the compressors of the engine (not shown) where it is fed into each of the blades for internal and external cooling of the blades.

Figure 2:
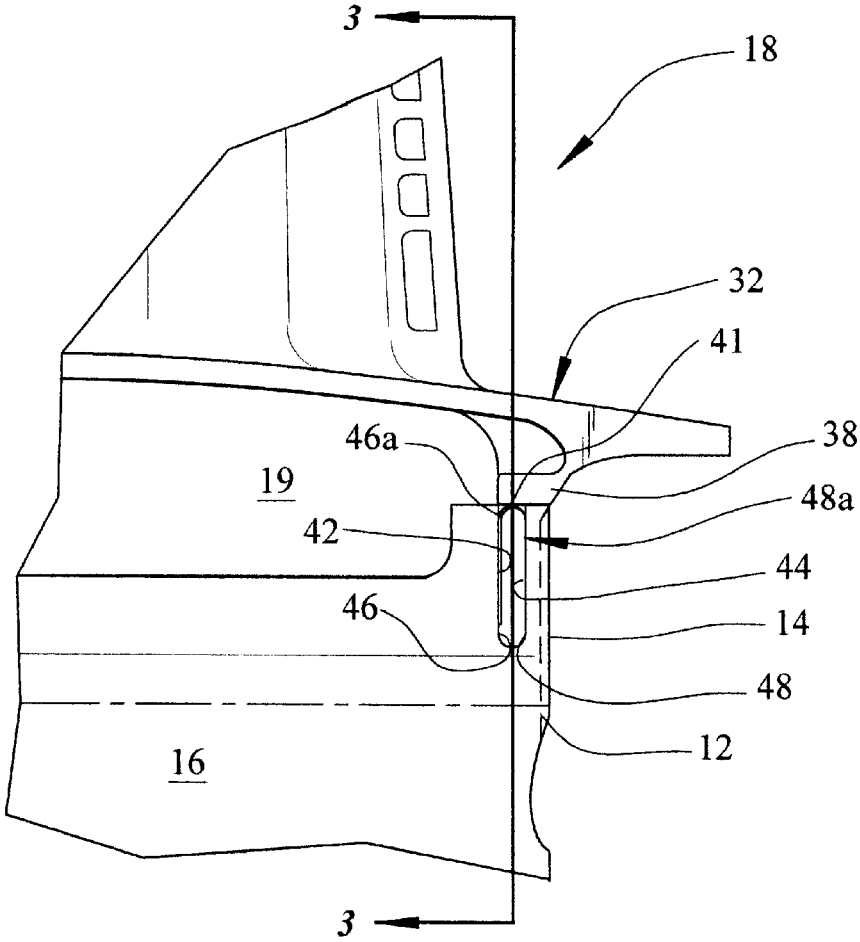
FIG. 2 is an enlarged view within the dash line A of FIG. 1 illustrating the details of the invention.

In its preferred embodiment this invention is utilized on a single stage turbine typically referred to as the high pressure turbine because it powers the high pressure stages of the compressor stages. As best seen in FIGS. 1 and 2 the turbine rotor generally illustrated by reference numeral 18 is comprised of plurality of circumferentially spaced turbine blades 20 suitably mounted in broach slots 15 formed in the rim 22 of the turbine disk 16. Preferably the mounting of the blades to the disk is by the well known broached fir tree attachment. While not germane to this invention the blades are internally air cooled from compressor discharge air (not shown) that is fed internally into the blade from the space between the blade and the rim of the disk. As noted in FIG. 1 the plurality of radially spaced apertures 25 extending adjacent to the trailing edge 26 of blade 20 discharges the cooling air from internally of the blade into the engine's fluid working medium. The blades 20 are held in axial position and prevented from falling out by the plates 28 and 30 mounted on the fore and aft faces of the disk 16. Each of the blades includes a platform 32 that is disposed between the airfoil portion 34 of the blade 20 and the root portion 36. The platforms 32 extend in all directions from the airfoil and abut end to end with adjacent blades around the circumference of the disk. Typically a well known feather seal 39 is mounted between adjacent blades under the platform to seal the air in cavity 19. Projecting radially downward on the aft side of the platform 32 is blade buttress 38 that is adjacent to the lug 14 of the disk 16. As noted the center 13 of seal 10 makes point contact with the underside of the buttress 38 and is retained thereby. This point contact occurs when the rotor is rotating as will be explained in more detail hereinbelow.

Figure 4:
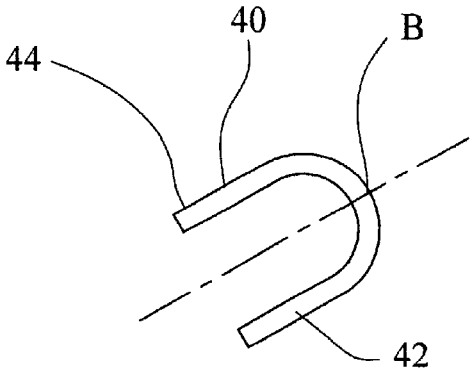
FIG. 4 is an enlarged sectional view of the seal taken along line 4—4 of FIG. 3.
Figure 3:
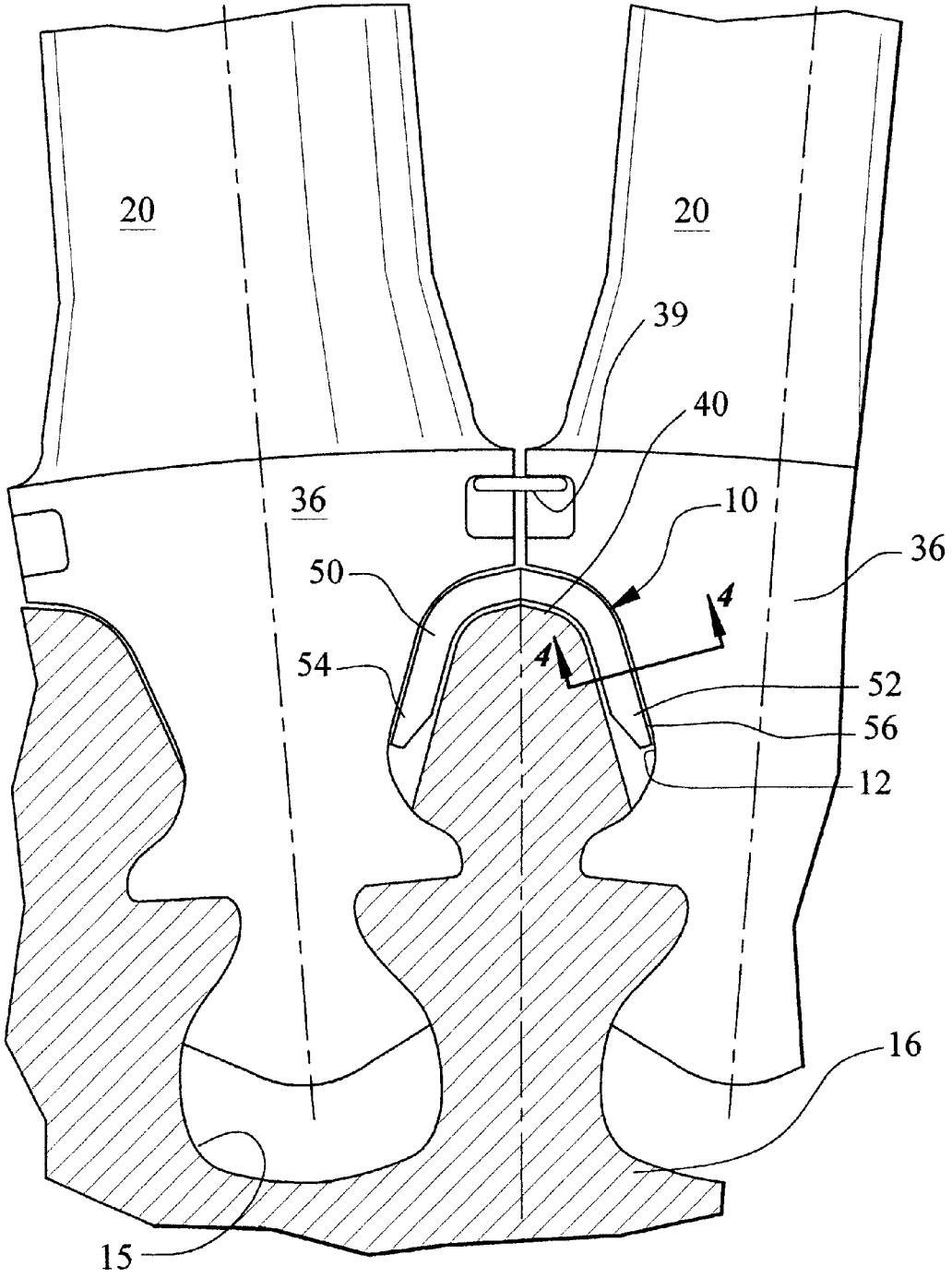
FIG. 3 is a partial view in section taken through the center of the seal along the line 3—3 of FIG. 2.

In accordance with this invention the seal 10 comprises a main body 40 formed from a single thin sheet of sheet metal made from a low strength annealed Cobalt alloy typically used in the feather seal referred to in the above paragraph. The seal is generally U-shaped in the plan view and in the cross section (best seen in FIG. 4) The seal is free floating in the groove 12 and moves radially outward until the center top portion 41 of seal 10 abuts against the buttress 38. Since the load point of the seal will be in the center 13 thereof the sides 42 and 44 of seal 10 will be deflected against the sides 46 and 48 of the disk groove at points 46*a* and 48*a*. However, this loading will be less than the load forcing the top center against the bottom surface of buttress 38. The blade buttress 38 is contoured so that the inner extensions 50 and 52 of the seal 10 will be loaded in contact with the lower surfaces 54 and 56 of the buttress 38 in the neck area of the blade by centrifugal force. This serves to seal this area as well as the other area defined above.

What has been shown by this invention is a seal that resists the high temperatures in this area but permit the seal to deform to contact the sides of the groove in the disk and the four surfaces of the blade buttresses and neck when they are manufactured under tolerances. This rim seal utilizes the centrifugal force due to the high rotor speeds to seal the area between the lug of the turbine disk and the platform buttresses of the blades which are located by the broach slots on either side of the disk lug. Essentially, the seal uses the centrifugal force on its mass to both load its front and rear faces against the side of the seal slot in the disk and to load the seal against both the underside of the platform buttresses and the sides of the blade neck under the buttresses.

Although this invention has been shown and described with respect to detailed embodiments thereof, it will be appreciated and understood by those skilled in the art that various changes in form and detail thereof may be made without departing from the spirit and scope of the claimed invention.

What is claimed is:

1. A seal for the blade/disk assembly of a gas turbine engine for preventing the leakage of cooling air, the blade having a platform and a buttress extending radially downward at the aft end of the blade and said blade being fitted into a broached slot formed in said disk, a disk lug extending radially from the disk, a radial groove formed in said disk lug, a U-shaped seal freely fitted into said grove and having the center of the bottom of the U abutting said buttresss when the blade/disk assembly is rotating, the sides of said U-shaped seal being deformed by the centrifugal force acting on said seal to abut the side walls of the groove and define a three-point seal.

2. A seal as claimed in claim 1 wherein said seal is U-shaped in cross section.

3. A seal as claimed in claim 2 wherein the said seal is made from a low strength annealed Cobalt alloy material.

4. A seal as claimed in claim 2 wherein each of said sides include an inner extension, said inner extension of each of said sides of said seal is forced by centrifugal force to contact the lower surfaces of the buttress for sealing off this area.

5. A seal as claimed in claim 4 wherein the said seal seals the area between the lug of the turbine disk and the buttresses of the blades located by the broach slots on either side of the disk lug.

* * * * *